US007171884B2

(12) United States Patent
De Torre

(10) Patent No.: US 7,171,884 B2
(45) Date of Patent: Feb. 6, 2007

(54) RESILIENT CUTTING BLADES AND CUTTING DEVICES

(76) Inventor: Robert P. De Torre, 1500 Monongahela Blvd., White Oak, PA (US) 15131

( * ) Notice: Subject to any disclaimer, the term of this patent is extended or adjusted under 35 U.S.C. 154(b) by 207 days.

(21) Appl. No.: 09/983,568

(22) Filed: Oct. 25, 2001

(65) Prior Publication Data

US 2003/0079593 A1 May 1, 2003

(51) Int. Cl.
*B26D 5/00* (2006.01)
*B26D 1/08* (2006.01)

(52) U.S. Cl. ..... 83/582; 83/501; 83/580; 83/698.31; 83/698.41; 83/951

(58) Field of Classification Search ..... 83/500–506, 83/675, 698.31, 695, 676, 694, 673, 835, 83/837, 847, 508, 56, 698.41, 348, 582, 644, 83/600, 542, 951, 430, 508.2, 481, 678, 674, 83/508.3, 482; 30/350, 357, 347, 348, 375; 451/526; 125/13.01
See application file for complete search history.

(56) References Cited

U.S. PATENT DOCUMENTS 1,814,867 A * 7/1931 Swift, Jr. ..... 83/117
1,949,066 A * 2/1934 Waner ..... 83/495
2,181,314 A * 11/1939 Burns ..... 226/191
3,501,280 A * 3/1970 Myers ..... 51/298
3,513,821 A 5/1970 Bouvier
3,527,123 A * 9/1970 Dovey ..... 76/107.1
3,577,636 A 5/1971 De Torre
3,769,868 A * 11/1973 Hornung ..... 83/349
3,799,025 A * 3/1974 Tsunoda ..... 83/835
3,828,633 A * 8/1974 Klingen ..... 83/56
3,935,774 A * 2/1976 Craddy ..... 83/355
3,939,745 A * 2/1976 Weeks et al. ..... 83/425.3

(Continued)

FOREIGN PATENT DOCUMENTS

DE 4200147 A1 7/1993

(Continued)

OTHER PUBLICATIONS

American Heritage Dictionary, 1976, Houghton Mifflin Company, Second edition, p. 923.*

(Continued)

*Primary Examiner*—Boyer D. Ashley
*Assistant Examiner*—Ghassem Alie
(74) *Attorney, Agent, or Firm*—Alex Mich, Jr.

(57) ABSTRACT

Steel reinforced tire fabrics are cut with long rigid bar blades, circular disc blades and disc and anvil blades. All of these blades may have an open relatively deep slot spaced close to the cutting edge that creates a resilient cantilevered spring element that includes the cutting edge. In response to cutting forces, the spring element will deflect and form a concave crossover area that improves cutting. A supporting material, particularly a precompressed supporting material, such as a precompressed or stretched polyurethane strip may be inserted into the slot. The supporting material limits or reduces the deflection of the spring element so that the yield strength of the spring element is not exceeded and it returns to its original position when the forces are removed. A precompressed supporting material exerts an outward force on the spring element. A polyurethane strip may be precompressed by stretching it before it is inserted into the slot. Two overlapping blades are used to cut the tire fabric, one or both can have the resilient spring features. More than one slot may be provided in a blade so there is more than one spring element in one blade. The blades can be used to cut other materials.

23 Claims, 5 Drawing Sheets

U.S. PATENT DOCUMENTS

| | | | | | |
|---|---|---|---|---|---|
| 3,994,193 | A | * | 11/1976 | Bodycomb | 83/501 |
| 4,026,176 | A | * | 5/1977 | Weiskopf | 83/502 |
| 4,112,801 | A | | 9/1978 | Diesch | |
| 4,258,593 | A | * | 3/1981 | Oinonen | 76/115 |
| 4,267,760 | A | | 5/1981 | Smith et al. | |
| 4,342,349 | A | * | 8/1982 | Lipman | 144/371 |
| 4,382,397 | A | | 5/1983 | De Torre | |
| 4,406,202 | A | | 9/1983 | Salje et al. | |
| 4,414,874 | A | * | 11/1983 | Barnes et al. | 83/488 |
| 4,512,072 | A | * | 4/1985 | Graham | 29/252 |
| 4,631,826 | A | | 12/1986 | Parke | |
| 4,660,401 | A | | 4/1987 | Kohama et al. | |
| 4,699,033 | A | * | 10/1987 | Gherardi | 83/348 |
| 4,858,324 | A | | 8/1989 | Weich, Jr. | |
| 4,972,750 | A | * | 11/1990 | Paavola | 83/500 |
| 5,138,921 | A | * | 8/1992 | Winckler | 83/501 |
| 5,152,206 | A | * | 10/1992 | Mulling | 83/425.3 |
| 5,182,976 | A | | 2/1993 | Wittkopp | |
| 5,211,096 | A | * | 5/1993 | Steidinger | 83/674 |
| 5,357,836 | A | * | 10/1994 | Stromberg et al. | 83/698.31 |
| 5,423,240 | A | * | 6/1995 | DeTorre | 83/500 |
| 5,438,900 | A | | 8/1995 | Sundström | |
| 5,525,091 | A | * | 6/1996 | Lam et al. | 451/1 |
| 5,549,623 | A | * | 8/1996 | Sharpe et al. | 606/171 |
| 5,596,918 | A | * | 1/1997 | Longwell et al. | 83/332 |
| 5,709,760 | A | | 1/1998 | Prakash et al. | |
| 5,839,423 | A | | 11/1998 | Jones et al. | |
| 6,001,116 | A | | 12/1999 | Heisler et al. | |
| 6,065,370 | A | | 5/2000 | Curtsinger et al. | |
| 6,244,151 | B1 | * | 6/2001 | Machamer et al. | 83/698.51 |
| 6,308,601 | B1 | * | 10/2001 | Seyna et al. | 83/56 |
| 2003/0075162 | A1 | * | 4/2003 | Hamilton | 125/13.01 |
| 2003/0116002 | A1 | * | 6/2003 | Mitteer | 83/558 |

FOREIGN PATENT DOCUMENTS

| | | | |
|---|---|---|---|
| DE | 4327197 | A1 | 2/1995 |
| EP | 0 318 174 | A2 | 5/1989 |
| EP | 0 390 133 | A1 | 3/1990 |
| GB | 2 248 577 | | 4/1992 |

OTHER PUBLICATIONS

McMaster-Carr Supply Company, Cleveland, Ohio, Catalog 107 © 2001, pp. 888, 890, 3146 and Cover.

* cited by examiner

RESILIENT CUTTING BLADES AND CUTTING DEVICES

TECHNICAL FIELD

This invention relates in general to cutting blades, devices incorporating cutting blades, and more specifically to resilient cutting blades and devices employing such resilient blades for cutting tire cord fabrics.

BACKGROUND OF THE INVENTION

Blades and devices for cutting tire cord fabrics are described in U.S. Pat. No. 5,423,240 issued to Robert P. DeTorre, the inventor herein, and incorporated herein by reference. The cutting or slitting of cord reinforced, calendered uncured elastomeric tire fabric continues to become a more difficult task with advances in tire design. Although the uniformly spaced parallel cords may be made from small diameter strands of nylon, polyester, or aramid fibers, the most popular and most difficult fabrics to cut continue to be those reinforced with steel cord. The steel cords, whether individual filaments, twisted multiple filaments, or mixtures of the two continue to become smaller and harder and more difficult to cut. Adding to the difficulty is the movement to sharper or smaller angles of the bias cut of the fabric. The angles now may be as little as 5 degrees. This results in longer cuts through the fabric sheet and longer cuts through individual filaments. Increases in tire tread widths also require longer cuts of the sheets. The blades, used to cut the fabric, overlap and the harder smaller filaments cut at smaller angles can be trapped between the overlapping blades resulting in torn filaments instead of clean cuts and/or smearing of the uncured elastomeric foundation of the fabric.

A variety of equipment is used to cut tire fabric. The equipment includes two circular blades that are also called discs or wheels, and a circular blade with an anvil or bar. The rotating circular blades and the disc and anvil equipment typically include air cylinders to impose opposing forces on the paired blades to force them together during the cutting operation. Another variety of equipment employs long rigid shear blades or guillotine blades. This equipment uses one stationary blade and one moving blade. The equipment is similar to the perhaps more familiar metal shears where a hydraulically operated blade moves up and down in a vertical plane essentially parallel to the stationary blade. The long moving blade may instead be mounted on a hydraulically operated radial reciprocating arm so the two blades are not essentially in a vertical plane until the arm moves the blade into contact with the stationary blade. These paired bar beam blades overlap each other in the cutting process and employ blade inclination pinch angles of about 1 to 4 degrees. The inclination angles are in the vertical plane and apparent in front views of the blades. The blades are essentially parallel in the horizontal plane with little or no crossover pinch angle. Small gaps or interferences provide the cutting point. The crossover pinch angle is the angle visible in top views of the blade. If the blade is cambered, it may have a very small crossover angle over the first half of a cut and a negative crossover angle after the center of the cut. A camber of 0.005 inches over an 80 inch blade gives a minute or insignificant pinch angle of about 0.003 degrees. The camber is intended to compensate for the machine deflection of the long blade rather than provide a cutting pinch angle.

The cutting point moves progressively from one end of the blades to the opposite end of the blades. The shear blades may be about 5 meters or about 16 feet in length or longer. They are mounted on equally long rigid blade holders. The blade holder may have a camber or arch so that a snugly fit blade will have the camber of the holder. The holder may, for example, be a 3 inch by 3 inch steel bar with numerous bolts along the length of the bar pulling the blade up against the holder. Jackscrews or push-pull bolts may be used to not only provide the initial camber to the blade but also to correct the blade camber after repeated use. The jackscrews or push-pull bolts may also be used to mount blades without a camber so the moving blade is essentially parallel to the stationary blade. These bolts may also be used to correct misalignments or wear after use. Both initial and corrective alignments are time consuming and labor intensive. Sometimes the actual incremental cutting of very thin paper is used to check and adjust the horizontal alignment of the blades. When cutting is occurring at one end of the blades the other end of the blades may be as much as 4 inches apart in the vertical plane. Periodic adjustments require periodic down times if quality cuts are to be maintained. Of the different blades in use in various tire fabric cutting equipment, the long rigidly mounted bar blades are subjected to the highest repetitive dynamic stresses. These stresses cause localized blade fractures and poor quality cuts. Particularly when the cutting edges become dulled, greater stresses are created not only on the blades as they hammer on each other but also on other elements of the machine. The side crowned tungsten carbide blades described in U.S. Pat. No. 5,423,240 have been successfully used in all of the described equipment, including the most dynamically stressed rigid blades, in 5 meter lengths. There is some reluctance, however, to use any carbide blade, not just the side crowned blade, because they are all considered to be brittle and subject to fracture. It would be most desirable to reduce the stresses on the long rigid cutting blades and on the other blades employed in cutting tire fabrics as well, not only because of the wear and tear on the blades themselves but also to reduce the wear and tear on bearings, gears, and other parts of the equipment.

BRIEF SUMMARY OF THE INVENTION

Briefly the present invention provides a resilient cutting blade for cutting tire cord fabric that improves the initial quality of the cuts and continues to provide quality cuts after prolonged use. Durability and life of the cutting blades is increased and the life of associated equipment is improved because of the lowered dynamic forces or stresses on the blades and associated equipment. The resilience is provided by a relatively deep slot or channel in the blade spaced close to the cutting edge, creating a cantilevered arm or spring element that includes the cutting edge. The cantilevered arm deflects locally in response to forces on the arm during contact with a paired blade and then returns to normal position when the cutting is finished. The slot may be used as is, i.e. empty, or may be filled with a supporting material such as polyurethane to control or reduce the deflection of the cantilevered element and inhibit unwanted permanent deflection due to forces that exceed the yield strength of the arm. It is especially useful to use a precompressed material in the slot such as a stretched polyurethane strip. In rigid blades, without the resilient features of this invention, substantial forces are generated by even small interferences of the blades and are all transmitted to the supporting framework. With the resilient blade, the deflection of the cantilevered spring element absorbs some of the stresses. The deflection occurs in a small moving crossover cutting area with desirable more pronounced pinch angles than in the rigid blades. The crossover area moves from one end of the bar to the other as the cutting progresses. The crossover cutting area has a concave or dished shape where the deflections vary from zero at the outer edges of the crossover area to the largest deflection at the center. A shorter, essentially stationary concave crossover area is provided in the resilient disc cutting blades. The resilient disc and anvil bar cutting blades provide the same advantages. The appropriate desired deflection of the cantilevered spring element or arm of all of these blades may be insured by actually measuring the deflection of particular configurations of the blades at the load point and on either side thereof. Using hardened tool steel for the resilient blade will provide high yield strengths to insure that there is not an undesired permanent deflection of the cantilevered spring element during use of the blade.

DESCRIPTION OF THE PREFERRED EMBODIMENTS

Figure 1:
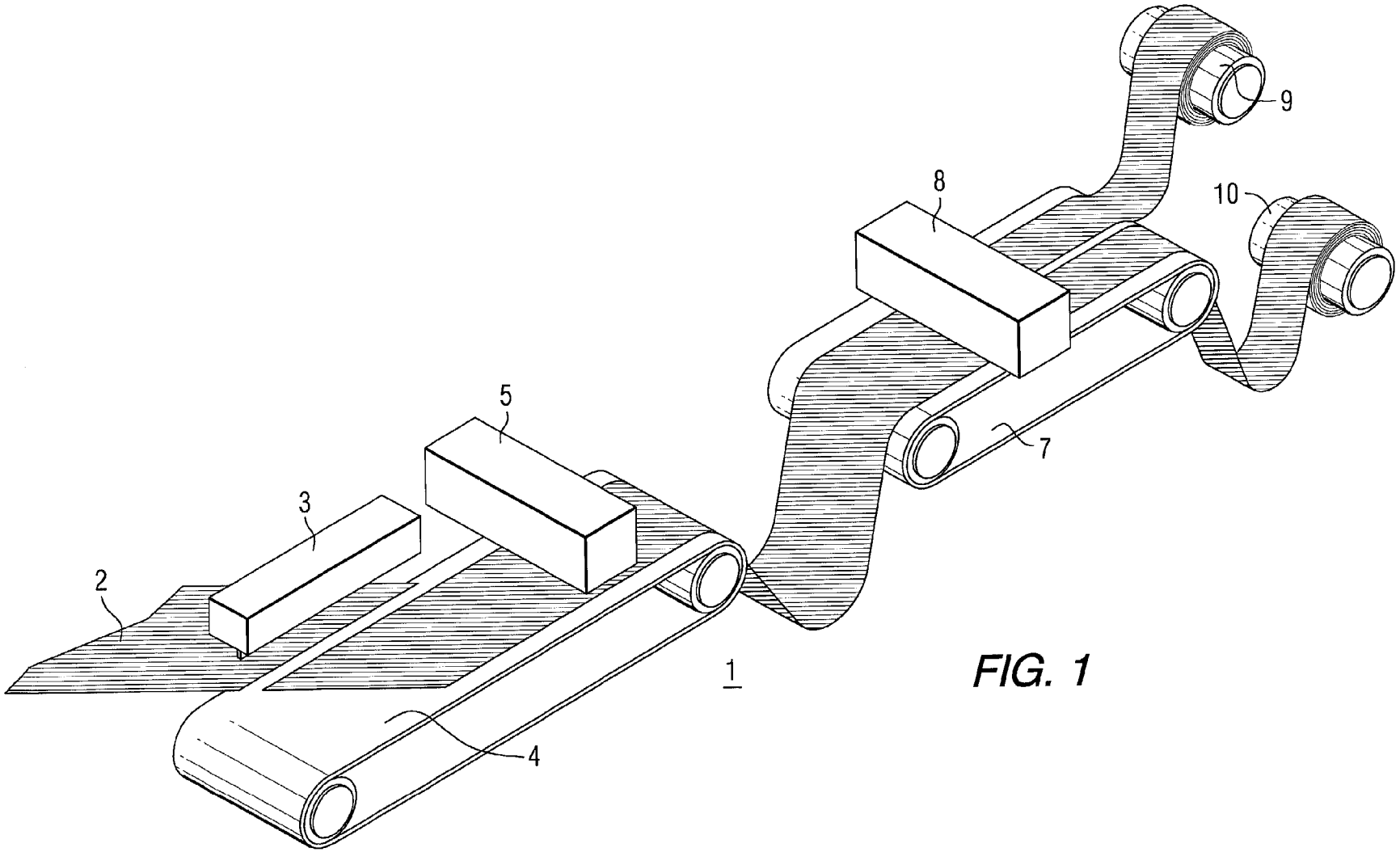
FIG. 1 is a schematic isometric view of several stations and the machinery associated therewith for bias cutting cord reinforced tire fabric sheet material, splicing the bias cut fabric together to provide a continuous sheet material that is cut or slit into narrower webs.

Shown in FIG. 1 is equipment 1 employed in making radial tire fabrics. A steel cord reinforced calendered tire ply fabric 2 is cut at station 3. Embedded in the uncured elastomeric sheet are a plurality of parallel steel cords. The cords may be single filaments or a plurality of filaments twisted together into a single strand. All are now generally made from hard high tensile steel. The advances being made in the quality, strength, and durability of tires have been related to the reinforcing cords and the orientation of the cords, which in turn have made the fabrics more difficult to cut. At the station 3, the fabric is cut at an angle that may, for example, vary from 5 to 90 degrees to the direction of the parallel cords. This bias angle of the cords is becoming steeper and results in cut segments of increased length. A pair of long shear blades, like those in FIGS. 2, 3, 4A, 4E, 4C, 4D and 4E, the two disc blades shown in FIG. 5 or a traveling version of the disc and anvil shown in FIG. 6 may be employed in this station. The bias cut segments fall onto conveyor 4, are butted or lapped together and seamed into a long continuous sheet or web at station 5. The continuous web is moved onto a conveyer belt 7, moved through cutting station 8 where the fabric can be cut parallel to the movement of the fabric into two continuous webs which are wound onto reels 9 and 10. When the reels are full of fabric the splicing is temporarily stopped so that empty reels may be substituted for the full reels. The full reels may then be moved downstream in the tire making process. The cutting mechanisms for station 8 may be the two disc blades shown in FIG. 5 or the disc and anvil shown in FIG. 6. An extrusion method is also used to make steel cord reinforced tire ply fabric. In that method, an uncured elastomer is extruded around a plurality of parallel fine diameter steel cords. The cutting tools of this invention are also suited for use in cutting such fabric. Bar blades and disc to bar blades employed to cut such fabric may be shorter because the current extruded sheet is not as wide as the widest calendered sheets.

Figure 2:
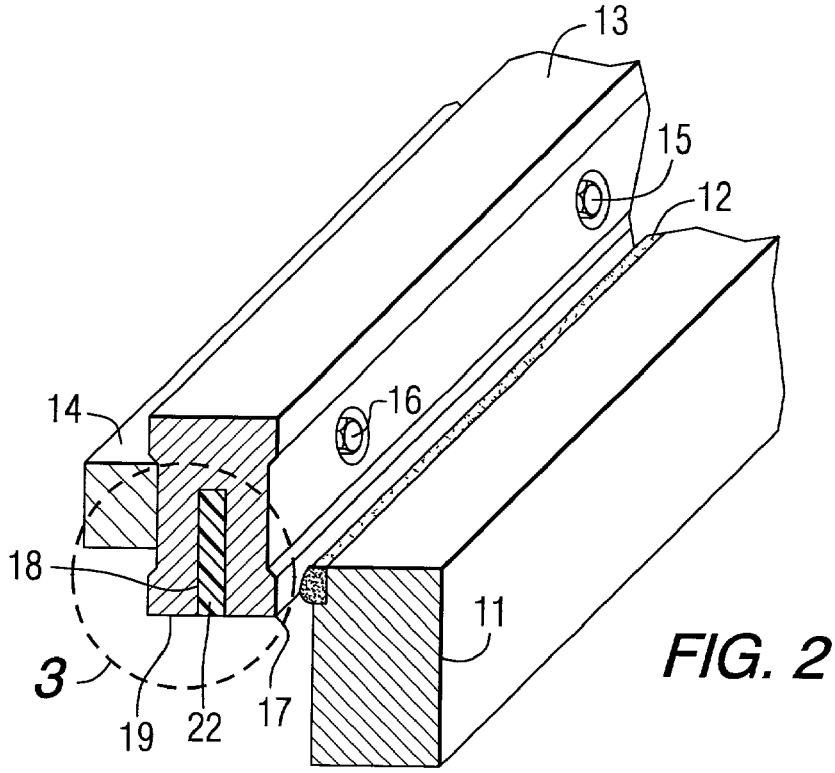
FIG. 2 is a fractured offset cross-sectional end view of long top and bottom shear blades of a guillotine beam or scissor cutter.
Figure 3:
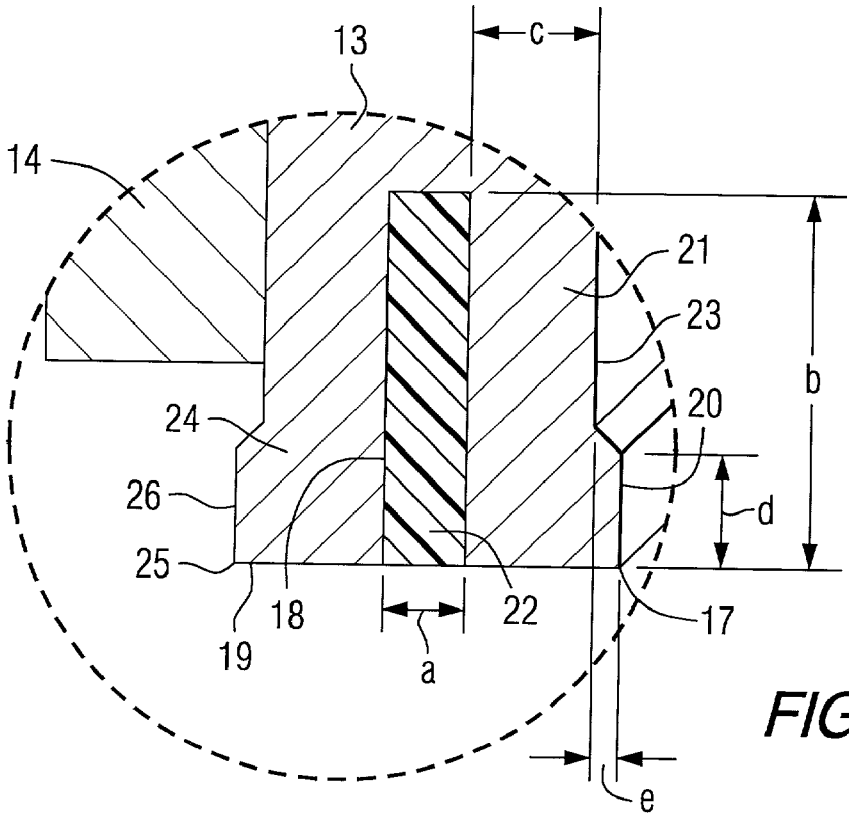
FIG. 3 is an enlarged cross-section of a portion of FIG. 2.

Referring now to FIGS. 2 and 3 there is illustrated a small intermediate portion of two long beam shear blades. In the offset sections shown in FIG. 2, the first and second blade bodies are overlapping and in contact with each other. The tire fabric that the blades would be cutting is not shown. Other portions of the blades (not shown) where the fabric has already been cut or has yet to cut fabric precede and follow the illustrated portion. These blades may be as long as 16 or 20 feet. The first fixed or stationary steel body lower blade 11 has a long longitudinal side crowned tungsten carbide insert 12 extending along the length of the blade. This blade may, for example, be a blade described in detail in U.S. Pat. No. 5,423,240. A second cooperating long resilient steel body blade 13, preferably made from a hardened tool steel having a Rockwell C hardness in the range of about 60 to 67, is attached or mounted to a long rigid steel movable blade holder 14 with, for example, a series of recessed bolts 15, 16 along the entire length of the blade. A cutting edge 17 runs the length of the blade 13 and acting together with the side crown 12 of blade 11 cuts the tire fabric. The resiliency of the blade 13 of this invention is provided by the continuous lateral open peripheral slot 18, which also extends along the length of the blade. The slot 18 projects inwardly into a depth of the body from the outer peripheral surface 19 and is spaced from but adjacent to side surface 20. The cutting edge 17 is at the intersection of peripheral surface 19 and side surface 20. The segment of the blade between the slot and the side surface 20 is a cantilevered spring element 21 that includes the cutting edge 17. The element 21 will deflect locally in a moving concave crossover cutting area when subjected to the cutting forces on the spring element as the two blades are cutting fabric from one end to the other. The cantilevered spring element 21 should spring back after the deflecting force is removed. The slot may, with further advantage, be filled with a supporting material 22, particularly a precompressed supporting material that will exert an outward force on the spring element. These long blades overlap in gradual increments across the width of the fabric by as much as two or three inches after the cut is made. To eliminate or reduce damage to the tire fabric caught between the blades and to preserve cutting forces, it is customary to provide a relief pocket 23 in the side of the blade. The blade may be reversed so that the cantilevered spring element 24 provides cutting edge 25 formed at the intersection of peripheral surface 19 and side surface 26.

Referring again to FIG. 3 for further blade details, it should be noted that the width of the slot is the dimension designated by the letter a, the depth of the slot and the length of the cantilevered spring element is the dimension designated by the letter b, the root width of the cantilevered spring element is the dimension designated by c and the length of the shoulder defining the relief pocket is the dimension designated by letter d. As a specific example of a long steel resilient blade of this invention, a slot having a width a of 0.0625 inches and a depth b of 0.75 inches was cut into a hardened tool steel blade having a Rockwell C hardness of about 60 to 63 to provide a cantilevered element 21 having a root width c of 0.25 inches and length b of 0.75 inches. The length of the shoulder d was 0.020 inches. This blade was about 5 meters in length with a width of 30-mm (1.18 inches) and a height of 80-mm (3.15) inches. A length of polyurethane flat belting having a Shore Durometer A hardness of 83, a width of 0.75 inches, and a thickness of 0.078 inches (Part No. 6075K14, Catalog of MacMaster Company) was stretched to a thickness of 0.060 inches and incrementally pushed into the slot 18. The polyurethane flat belting or strip shrinks or compresses in thickness when stretched. When it is inserted into the narrower slot, it seeks to return to its original shape. Unable to do so completely because it is constrained in the slot, it not only supports but also exerts an outward force against the cantilevered spring element. When an opposing force is imposed on the spring element during the cutting operation, there is an immediate existing opposition that resists and reduces the deflection of the spring element. A supported or prestressed spring element can withstand larger forces without yielding or permanently deforming than an unsupported spring element. It may even be more advantageous to use this technique of prestressing a cantilevered spring element in blades that are made of steel with lower yield strengths than hardened tool steel. While the above described polyurethane has particular advantages, it should be understood that other precompressed materials inserted into the slot would offer benefits in resisting deflection and consequent deformation. Supporting materials inserted into the slot that are not precompressed may not prestress the spring element but it will also resist deflection of the spring element after there has been some movement of the element. In addition to the depth of the slot and the distance of the slot to the side surface, blade designers can use the properties of the supporting material as another tool to control the deflection or spring rate of the cantilevered spring element. Another benefit of filling the slot is keeping material debris out of the slot that could even affect the deflection.

It should be understood, however, that there is an essential benefit in the resiliency provided by the cantilevered spring element, whether the slot is filled or not. A concave crossover contact area important to the cutting is a consequence of the resiliency. It is not visible to the naked eye, particularly if one is observing the actual cutting of tire cord fabric. The maximum deflection may be up to about 0.010 inches at the center of the crossover, tapering to zero on both sides of the center. In deflection tests conducted on a segment of a resilient bar blade of this invention, a force was imposed on the cantilevered spring element adjacent to a sensitive accurate dial gauge. In this instance, the largest deflection of about 0.005 inches was measured at the load point. The deflection, measured by the dial gauge at points moving away from the load point, tapered down to smaller deflections until a reading of zero occurred at a distance over one inch away from the center. This is evidence that the deflection of the resilient blade in operation occurs in a small concave crossover contact area with a noticeable pinch angle on both sides of the center points. Prior art rigid blades that do not have the resilient features of this invention are believed to distribute the deflection over the entire blade length. This results in high forces that are distributed not only along the blades but are also transmitted to the supporting framework. Current equipment is designed to withstand these high forces. It is believed that significant advantageous equipment redesign will be possible because of the properties of the blades of this invention.

There is also a demonstrable operating advantage attributable to smaller shoulder length, for example the dimension 0.020 inches for the shoulder d on the resilient blade described hereinabove and illustrated in FIGS. 2 and 3. The shoulders such as d on prior art blades are 0.080 or even 0.5 inches in length. The longer shoulder in prior art blades results in a larger contact surface area when the overlapping blades rub together. Forces that should be directed to cutting the fabric are dissipated and wasted in the large blade contact areas that rub together. The ability to use a shorter shoulder in the resilient blades results in more efficient cutting because far less force is lost in the smaller contact area. The shoulder will also rub against the fabric during the cutting operation. A reduced shoulder d about 0.020 inches or less will reduce the amount of fabric rubbing between the overlapping blades giving a better cut and less smearing or other damage to the fabric. It is because of the deflection in the resilient blades and the elimination of hammering that the shoulder can be safely reduced, i.e. without chipping blades during use. The pocket or setback distance e from the cutting edge, as shown in FIG. 3, should be greater than that employed in the rigid blades. The range for rigid blades is about 0.040 to 0.080 inches. In the resilient blade, that should be increased by the maximum deflection of the resilient blade.

It should be understood that cutting blades are expected to and will be subjected to many cycles of cutting. All blades will become dull and eventually require sharpening. The cantilevered arm or spring element will be subjected to hundreds of thousands, even millions of deflections raising the possibility of failure due not only to overstressing but also due to metal fatigue. It is expected that properly designed blades with bodies of hardened tool steel will meet these demands. It is advantageous that such blades be made by cutting a slot in an already hardened blade. The alternative of first cutting the slot and then hardening, risks the possibility of distortion and residual stresses that could decrease the useful life of the blade. The hardening process itself, because of the heating to high temperatures, quenching, perhaps even stress relieving, would make it more difficult to consistently achieve important design parameters. The slot described hereinabove with the specific dimensions was cut in the hardened tool steel with a 1/16 inch wide Borizon CBN abrasive wheel. This wheel is made from a cubic boron nitride material. A diamond abrasive wheel can also be used. Repeated small cuts are made along the length of the blade with a coolant fluid sprayed on the wheel and blade as the wheel traverses the length of the blade. The coolant prevents overheating and loss of hardness. The abrasive wheel should have a slight radius so that the root of the slot does not have a sharp angle that might be a high stress point with an increased risk of fatigue failure. The risk of fatigue failure is greater when the slot is not filled. The risk is reduced when the polyurethane strip is deployed in the slot.

Referring now to the sequence of FIG. 4, there is illustrated in cross-section a number of different combinations of long bar blades where the upper blade is movable and the lower blade is stationary. In FIG. 4A, the lower stationary steel blade 30 has a tungsten carbide insert 31 at the peripheral and side surface of the blade. Some carbide blades have a cutting edge at the intersection of these surfaces. A side crowned cutting edge is illustrated here. The upper hardened tool steel blade 32 has two slots, 33 and 33' with polyurethane strips 34 and 34' inserted into the slots. In this embodiment the plurality of slots provides for a plurality of cantilevered spring elements 35, 35' and a plurality of cutting edges 36, 36' on the upper blade at the intersection of peripheral surfaces 37, 37' itch side surfaces 38, 38'. As a cutting edge becomes dull the blade may be switched so that a new sharp cutting edge engages the longer lasting side crowned tungsten carbide blade. This is an advantage to users who must send dull blades out to be resharpened. The two slots could provide up to four different cantilevered spring elements and four cutting edges. While a resilient blade may have a pronounced effect on the life of a side crowned tungsten carbide blade by reducing fractures and the like, it will also provide the same advantages when paired with square cut tungsten carbide blades.

Figure 4A:
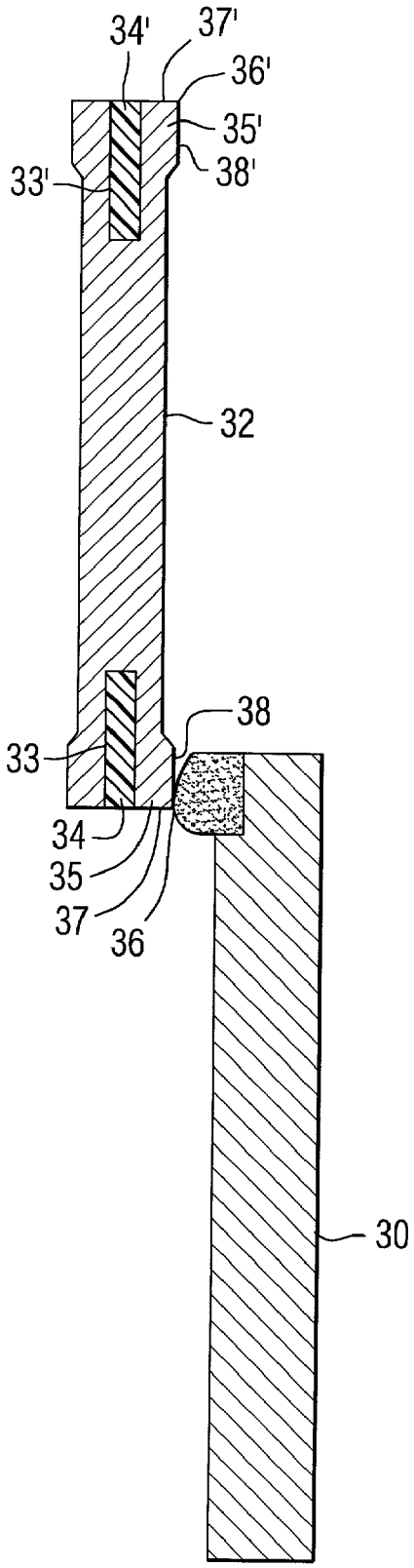
FIGS. 4A, 4B, 4C, 4D and 4E are cross-sectional views of variations of the beam or scissor blade combinations illustrated in FIG. 2.
Figure 4B:
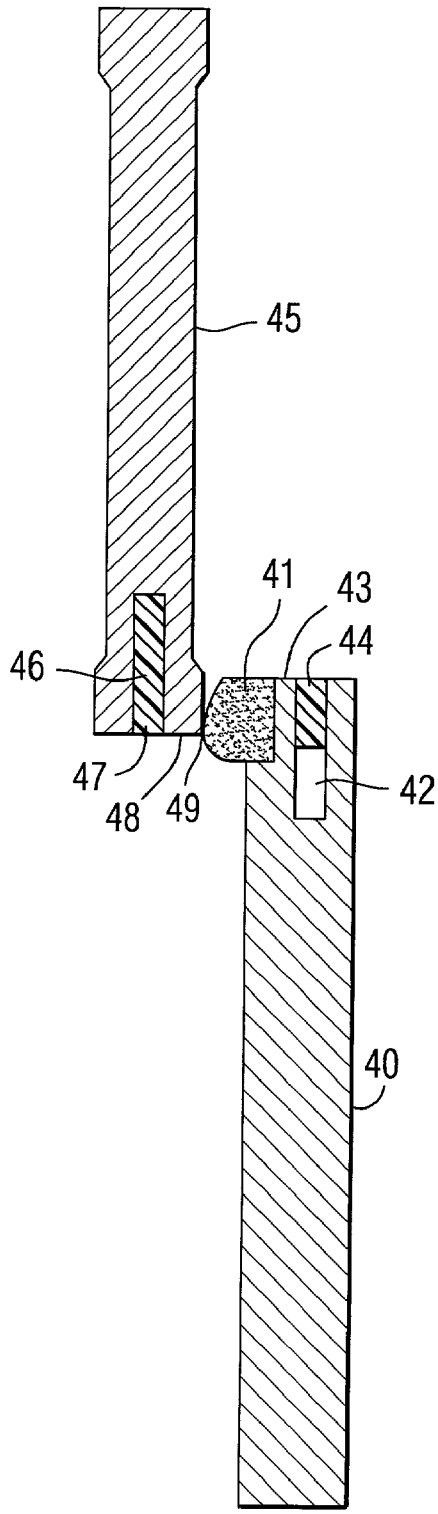

In FIG. 4B, the lower steel blade 40 has a side crowned tungsten carbide insert 41 and, more importantly, a slot 42 defining a cantilevered spring element 43 that includes the side crowned carbide insert and a polyurethane insert 44. A one foot long test section of such a blade had a 1/16 inch wide slot cut 5/8 of a inch deep cut into the blade at a distance of 0.270 inches from the cutting edge of the crowned carbide insert. A polyurethane strip 1/16 inch thick and 0.310 inch wide was inserted into the slot. A 1600 pound load on the blade produced a 0.004 inch deflection at the load point and 0.0009 inch at a distance of one inch from the load. A 4,000 pound load would produce a 0.010 inch deflection at the load and a 0.005 inch deflection at a distance of about one inch from the load. The crossover angles at the two loads were 0.17 and 0.343 degrees, respectively. The blade 40 may be paired with an upper hardened steel blade 45 that has a slot 46 filled with a polyurethane strip 47. In this embodiment, we have illustrated resilient upper and lower blades. The upper blade 45 with cantilevered spring element 48 and cutting edge 49 can be the same blade that is illustrated in FIGS. 2 and 3. It should be noted that the lower blade 40 is not ordinarily made from a hardened tool steel because the tungsten carbide insert is typically brazed to the blade. Brazing temperatures may be high enough to temper the hardness of tool steel, so there is no reason to use hardened tool steel. Because the yield strength of the blade 40 is lower than the yield strength of blade 45, the use of the polyurethane insert may be more important than inserting it into a hardened tool steel blade. The resiliency of two paired cutting blades could further lower forces transmitted to supporting equipment and further improve cutting efficiency and blade life.

Figure 4C:
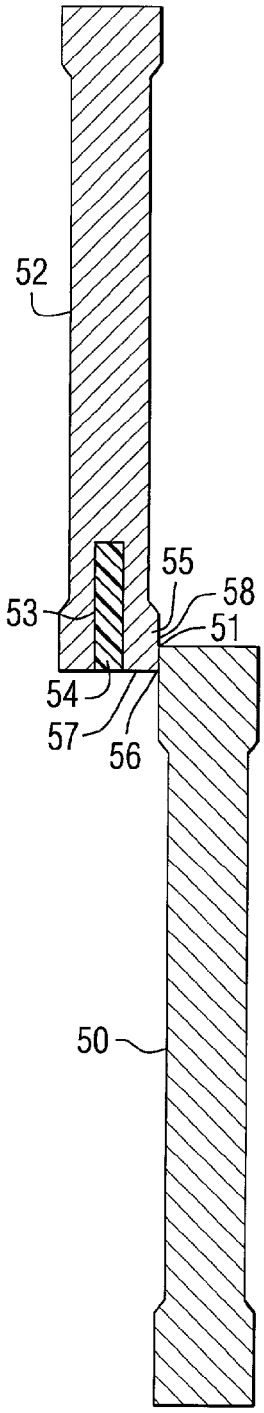

In FIG. 4C the lower blade 50 has a cutting edge 51. The blade is made from a hardened tool steel and is representative of the typical rigid bar blades that are known in the art. The blade 50 is paired with a hardened tool steel blade 52 having a slot 53 and a polyurethane insert 54. The slot extends from the peripheral surface inwardly into a depth of the body and is located at a distance from the side surface to provide an element 55 that will deflect in response to cutting forces. The element 55 is the cantilevered spring and 56 is the cutting edge at the intersection of the peripheral surface 57 and side surface 58. This embodiment illustrates the utility of a resilient blade with the widely used hardened tool steel rigid blade, a blade different from the side crowned tungsten carbide blade.

Figure 4D:
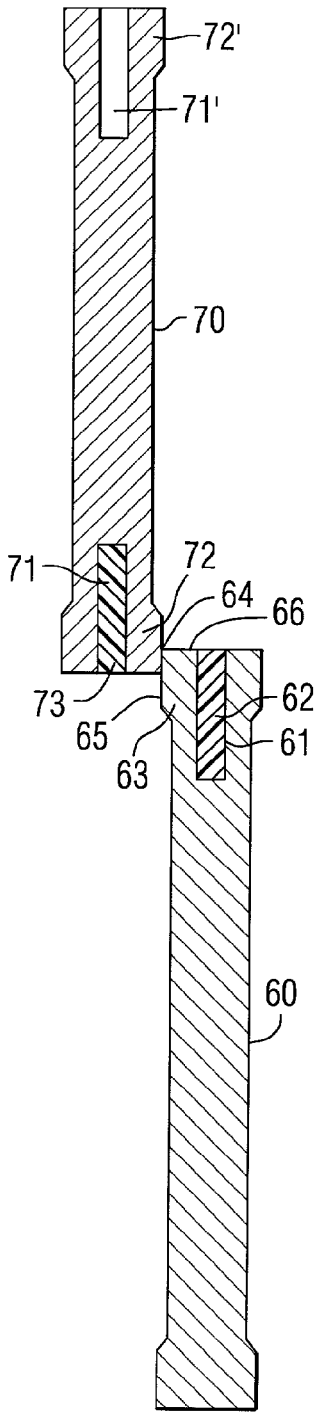

The blade 60 in FIG. 4D has a slot 61 with an insert of a non-metallic polyurethane supporting strip 62, cantilevered spring element 63 and cutting edge 64 at the intersection of side surface 65 and peripheral surface 66 of the blade. The upper movable hardened tool steel blade 70 has slots 71 and 71', both of which provide cantilevered spring elements 72, 72' at the peripheral and side surfaces of the blade. In this embodiment only the slot 71 has a polyurethane strip insert 73. The slot 71' does not have an insert and provides a user of the blade with the option of using one side or the other. The lower blade can have two cantilevered spring elements and four cutting edges, while the upper blade can have four cantilevered spring elements and four cutting edges.

Figure 4E:
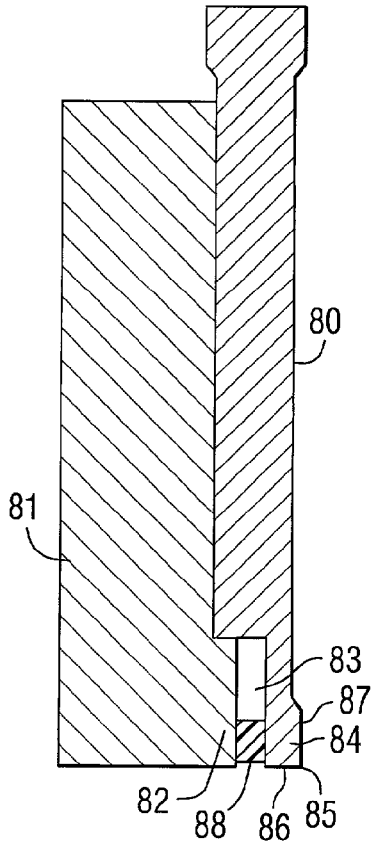

The cantilevered spring element or arm may also be formed by only a longitudinal notch in the body of the blade. An appropriately designed cooperating blade holder could form a slot that is adjacent to a cantilevered spring element having a cutting edge. In FIG. 4E a movable long hardened tool steel bar blade 80 is attached to an L shaped mounting bar 81. The blade is securely attached to the mounting rod with spaced bolts (not illustrated). The short arm 82 of the L shaped mounting rod projects into the notch 83 cut into the blade to form a slot. A cantilevered spring element 84 has a cutting edge 85 at the intersection of peripheral surface 86 and side surface 87. A polyurethane strip 88, either stretched or not, may be inserted into the slot either before or after the blade is bolted to the mounting rod. In this embodiment, it should be easier to incorporate polyurethane strips into the slot, particularly those that are stretched to provide a precompressed insert that will exert an outward force on the spring element. Better control over the desired deflection characteristics of the interacting cantilevered spring element is provided by a precompressed insert In FIG. 5, rotatable circular or disc blade 90 with an annular side crowned tungsten carbide insert 91 in the first body is fastened to a rotatable mounting plate 92 with bolts 93, 94. A circular rotatable hardened tool steel blade 95 is securely fastened to mounting plate 96 with bolts 97, 98. An open annular slot 99 extends radially inward from the peripheral surface 100 of the second body to form a circular cantilevered spring element 101 having a cutting edge 102 at the intersection of the peripheral surface 100 and side surface 103. A polyurethane O-ring 104 is inserted in the slot 99 to primarily keep the slot clean and a smaller degree of support compared to the support provided by a longer and/or wider polyurethane strip. The mounting plates are keyed (not illustrated) to counter rotating shafts on axes spaced apart so the blades overlap and contact each other in a manner known in the art. The blades are forced together with air cylinders (indicated by the arrows) at forces that may vary from about 280 to 800 pounds. These blades and cutting apparatus employing these blades would be particularly useful for cutting extruded steel cord fabrics that may be narrow enough to make only one or two radial tire belts.

Figure 5:
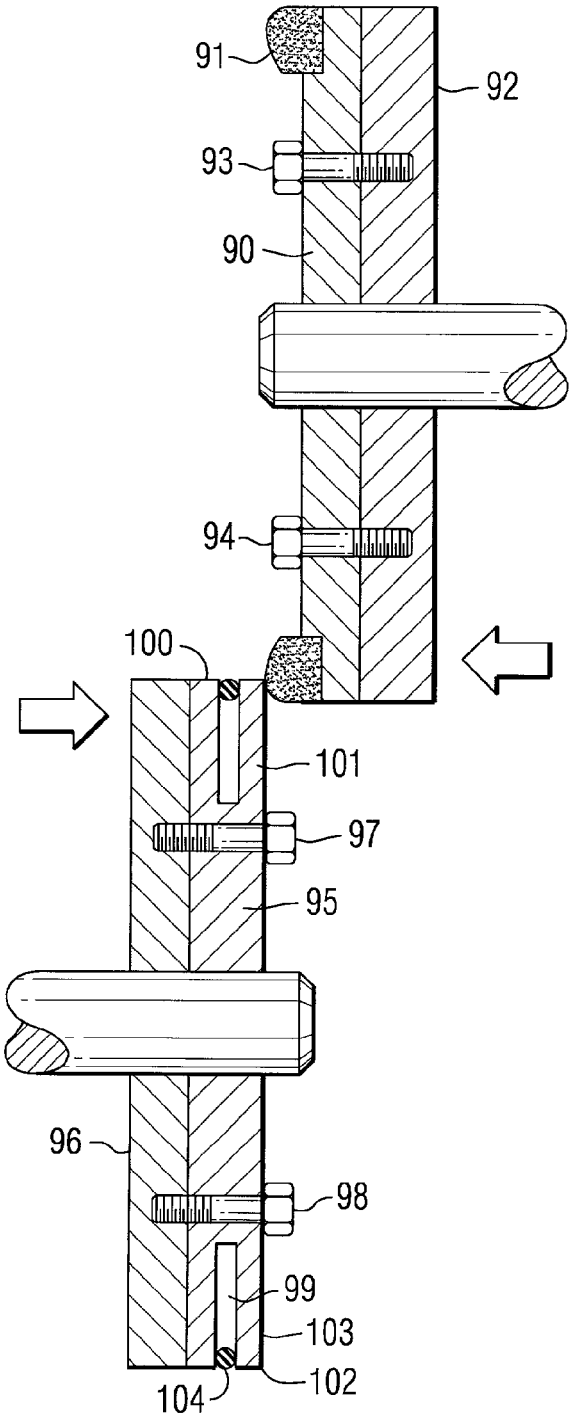
FIG. 5 is a cross-sectional view of two rotatable disc blades for cutting tire fabric.

As an example of the resilient blade of FIG. 5, a 0.775 inch deep and 1/16inch wide slot was cut into a 7-inch diameter hardened tool steel blade having a thickness of 1/2 inch. The outer side surface (away from the mounting plate) of the slot 99 was spaced about 7/32 inches from the side surface of the blade to provide a circular cantilevered spring element having a thickness of 7/32 inches. A 0.120 inch solid diameter polyurethane O-ring compressed about 10% was inserted into the slot that was flared at the top to accommodate the O-ring. Deflections of the cantilevered spring element were measured with a sensitive dial gauge at the load point with various loads. At a (1) 140-pound load the deflection was 0.0015 inches, at a (2) 280-pound load it was 0.002, at a (3) 420-pound load it was 0.003, at a (4) 635-pound load it was 0.004, and at a (5) 847-pound load it was 0.005 inches. The deflection at a distance of 1 and 1/8 inches from the load point were measured to be zero at the (3) 420 pound load. Like the bar to bar blades, the disc to disc and disc to anvil blades will have a concave crossover contact area of cutting when cutting fabrics. In the disc to disc cutting operation, there will be more of a stationary concave crossover area because the cutting area is essentially stationary between the rotating blades.

Figure 6:
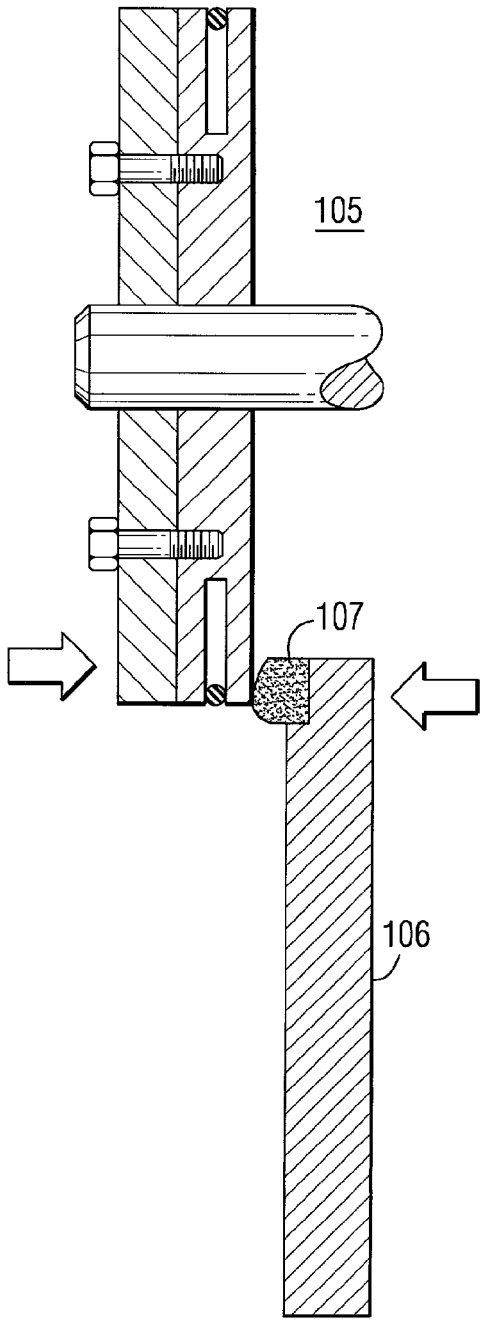
FIG. 6 is a cross-sectional view of a rotatable disc blade and a longitudinal bar or anvil.

In FIG. 6, we have illustrated a resilient blade assembly 105 identical to the lowered assembly of FIG. 5 paired with a anvil or bar blade 106 having a side crowned tungsten carbide insert 107. The lower anvil blade is a shorter version of the lower blade of FIG. 4A. The arrows in FIG. 6 indicate the forces on the blades by air cylinders. The forces may vary from about 280 to 800 pounds. Again, the resilient blade may also be paired with square cut tungsten carbide anvil blades or hardened tool steel anvil blades. The resilient disc blades may also have circular notches that cooperate with mounting plates that have an L shaped cross-section, like the mounting bars of FIG. 4E, to form slots and cantilevered spring elements. Disc, anvil, or long bar blades that are too thick to form two resilient cantilevered spring elements with a single central slot may be made with two slots located close to each side of the blade to form the resilient cantilevered spring elements. Large thick disc blades may be made in two circular sections that provide a continuous open annular slot when bolted together to form a blade. A supporting insert may be sandwiched in the slot between the two sections. In apparatus that has two overlapping blades cutting the tire fabric, at least one of the blades should be a resilient blade. However, both of the blades may be resilient and provide further advantages not only in cutting fabric but also in equipment design.

Disc blades illustrated in FIGS. 5 and 6 typically vary between 5 and 23 inches in diameter but may be smaller or larger. When running against a side crowned tungsten carbide blade, the resilient blade should be dished radially inwardly from the cutting edge to provide a relief angle of about 2 degrees. The relief is needed so the cutting edge of the resilient blade remains in contact with the side cutting edge of the crowned carbide blade. Without the relief, the side of the resilient blade rather than the edge may contact the crowned cutting edge of the carbide blade. Poor quality cuts could be the result. The disc to disc and the disc to bar blades may be mounted on movable carriages that traverse and cut the tire fabric as the carriage moves across the width of the fabric. With the resilient disc to disc and disc to bar blades of this invention, the fabric can be cut in both directions of movement across the fabric width. This is because the concave crossover contact area of cutting will provide a desirable pinch angle in both directions even when the blades are set parallel to each other. With the normal rigid blades the pinch angle is provided by offsetting the axes of the paired rotating blades. The pinch angle in the normal blades will be useful in only one direction of cutting. In the disc to anvil combination, the resilient blade will provide longer sharpness life.

The thickness and length of the cantilevered spring element in the blades of this invention are determined by the width and depth of the slot in the blade and the distance of the slot from the cutting side of the blade. It is important in all of the blade combinations that the cantilevered spring element is deflected, preferably sufficient to form a concave crossover cutting area when the blades are in operation. The length of this area, from the point of maximum deflection to the points on either side thereof where there is no measurable deflection will vary from as large as about six inches to one inch or even less, depending on the size of the blades, the forces involved, and the materials used. It is essential that the cantilevered spring element be resilient, i.e. to deflect when cutting and return to its normal position or near when the deflecting force has ended. The deflection and other characteristics of the spring element will be influenced by the characteristics of the material inserted into the slot, if any. The advantages of prestressing the spring element with the insertion of precompressed material into the slot has been discussed above. It should be understood that it may utilized with any of the resilient blades. It should also be understood that where both blades have slots and both have cantilevered spring elements, the elements on both blades will deflect.

While the preferred embodiments have been described as tools for the difficult cutting of tire fabrics, they may be used to cut other material with the advantages that attend resilient blades.

The invention claimed is:

1. A resilient shear cutting blade of hardened tool steel, suitable for cutting tire cord fabric, having a peripheral surface, a side surface intersecting the peripheral surface, a cutting edge at the intersection of said surfaces, a slot extending inwardly into a depth of the blade from the peripheral surface and spaced from the side surface to form a resilient cantilevered spring element supporting the cutting edge, the slot located at a distance from the side surface and to a depth in the blade that will provide a deflection of the spring element in response to a cutting force imposed on said spring element.

2. The resilient blade of claim 1 wherein a supporting material is disposed in the slot.

3. The resilient blade of claim 1 wherein a precompressed supporting material is disposed in the slot.

4. The resilient blade of claim 3 wherein the supporting material is a stretched polyurethane strip.

5. A resilient cutting blade suitable for cutting tire cord fabric comprising a bar having a peripheral surface, a side surface intersecting the peripheral surface, a cutting edge at the intersection of said surfaces, a slot extending inwardly into a depth of the bar from the peripheral surface and spaced from the side surface to form a resilient cantilevered spring element supporting the cutting edge, the slot extending laterally and continuously along the cutting edge.

6. The resilient blade of claim 5 wherein a precompressed polyurethane supporting strip is disposed in the slot.

7. The resilient blade of claim 1 wherein the blade is a circular disc and the slot is an annular slot extending radially inwardly from the circular periphery.

8. The resilient blade of claim 7 wherein a supporting material is disposed in the slot.

9. The resilient blade of claim 8 wherein the supporting material is a precompressed polyurethane strip.

10. The resilient blade of claim 5 wherein the bar has an additional peripheral surface, an additional side surface intersecting the additional peripheral surface, a slot extending inwardly from the additional peripheral surface and spaced from the additional side surface to provide an additional resilient cantilevered spring element supporting an additional cutting edge.

11. The resilient blade of claim 1 wherein the depth of the slot is from about ¼ to about 1 inch and the slot is spaced from about ¼ to ½ inch from the side surface.

12. In a shear cutting device, overlapping shear blades comprising a first cutting blade having a peripheral surface, a side surface intersecting the peripheral surface, a cutting edge at the intersection of said surfaces, a second cutting blade having a peripheral surface, a side surface intersecting the peripheral surface, a cutting edge at the intersection of said surfaces on the second blade, a slot on said second blade extending inwardly from the peripheral surface and spaced from the side surface to form a resilient cantilevered spring element, the slot located at a distance from the side surface and to a depth in the second blade, the blades arranged to provide a deflection of the spring element in response to the cutting forces between the two blades when cutting material.

13. The device of claim 12 wherein the second blade is hardened tool steel, the slot extends laterally and continuously along the cutting edge, and the deflection of the spring element is a concave crossover area.

14. The device of claim 13 wherein a supporting material is disposed in the slot.

15. The device of claim 14 wherein the supporting material is a precompressed polyurethane.

16. The device of claim 12 wherein the first and second blades are long bars of hardened tool steel, the slot extends laterally and continuously along the second cutting edge and a precompressed polyurethane strip is disposed in the slot.

17. The device of claim 12 wherein the first and second blades are circular discs of hardened tool steel, the peripheral surfaces of the blades are circular, the slot in the second blade is an annular slot extending radially inwardly from the circular peripheral surface and the deflection of the cantilevered spring is a concave crossover area.

18. The device of claim 12 wherein the first and second blades are circular discs of hardened tool steel, the peripheral surfaces of the blades are circular, the slot in the second blade is an annular slot extending radially inwardly from the circular peripheral surface and a precompressed supporting material is disposed in the slot.

19. The device of claim 12 wherein the first and second blades are circular discs of hardened tool steel, the peripheral surfaces of the blades are circular, the slot in the second blade is an annular slot extending radially inwardly from the circular peripheral surface, the deflection of the cantilevered spring element is a concave crossover area and a precompressed supporting material is disposed in the slot.

20. The device of claim 12 wherein the first blade is a bar of hardened tool steel, the second blade is a circular disc of hardened tool steel, the peripheral surface of the second blade is circular, the slot in the second blade is an annular slot extending radially inwardly from the circular peripheral surface, the deflection of the cantilevered spring element is a concave crossover area, and a supporting material is disposed in the slot.

21. The device of claim 12 wherein the supporting material is a precompressed polyurethane strip.

22. The device of claim 12 having a slot on said first blade extending inwardly from the peripheral surface and spaced from the side surface forming a resilient cantilevered spring element, the slot located at a distance from the side surface and to a depth in the first blade that will provide a deflection of the spring element in response to the cutting forces between the two blades when cutting material.

23. The device of claim 17 having an annular slot in the first blade extending radially inwardly from the circular peripheral surface forming a cantilevered spring element that deflects in response to cutting forces.

* * * * *